United States Patent [19]

Lee

[11] 4,419,968

[45] Dec. 13, 1983

[54] METHOD AND APPARATUS FOR REMOVING HYDROGEN SULFIDE FROM FUEL FOR AN INTERNAL COMBUSTION ENGINE

[75] Inventor: Roy C. Lee, Bartlesville, Okla.

[73] Assignee: Phillips Petroleum Company, Bartlesville, Okla.

[21] Appl. No.: 403,977

[22] Filed: Aug. 2, 1982

Related U.S. Application Data

[62] Division of Ser. No. 125,434, Feb. 28, 1980, Pat. No. 4,347,811.

[51] Int. Cl.[3] ..... F02B 43/08

[52] U.S. Cl. ..... 123/3; 123/1 A; 423/230

[58] Field of Search ..... 123/1 A, 3, DIG. 12; 423/230, 213.7; 55/74, 73; 208/134, 214

[56] References Cited

U.S. PATENT DOCUMENTS

| | | | |
|---|---|---|---|
| 3,072,458 | 1/1963 | Page | 423/213.7 |
| 3,635,200 | 1/1972 | Rundell et al. | 123/3 |
| 4,003,343 | 1/1977 | Lee | 123/3 |
| 4,016,836 | 4/1977 | MacKay et al. | 123/3 |
| 4,064,840 | 12/1977 | Vierling | 123/3 |
| 4,088,736 | 5/1978 | Courty et al. | 423/230 |

*Primary Examiner*—William A. Cuchlinski, Jr.
*Assistant Examiner*—E. Rollins Cross

[57] ABSTRACT

Two reactors containing an absorbing composition are utilized to remove hydrogen sulfide ($H_2S$) from a fuel being utilized as fuel for an internal combustion engine. The reactors are heated to reaction temperature with the engine exhaust gas and the engine exhaust gas is also utilized to regenerate the absorbing composition. Continuous removal of hydrogen sulfide is achieved by utilizing the absoring composition in one reactor to remove $H_2S$ while the absorbing composition in the second reactor is regenerated. When the absorbing composition in the first reactor becomes sulfided to the extent desired, the absorbing composition in the second reactor is then utilized to remove $H_2S$ while the absorbing composition in the first reactor is regenerated.

6 Claims, 1 Drawing Figure

Figure 1:
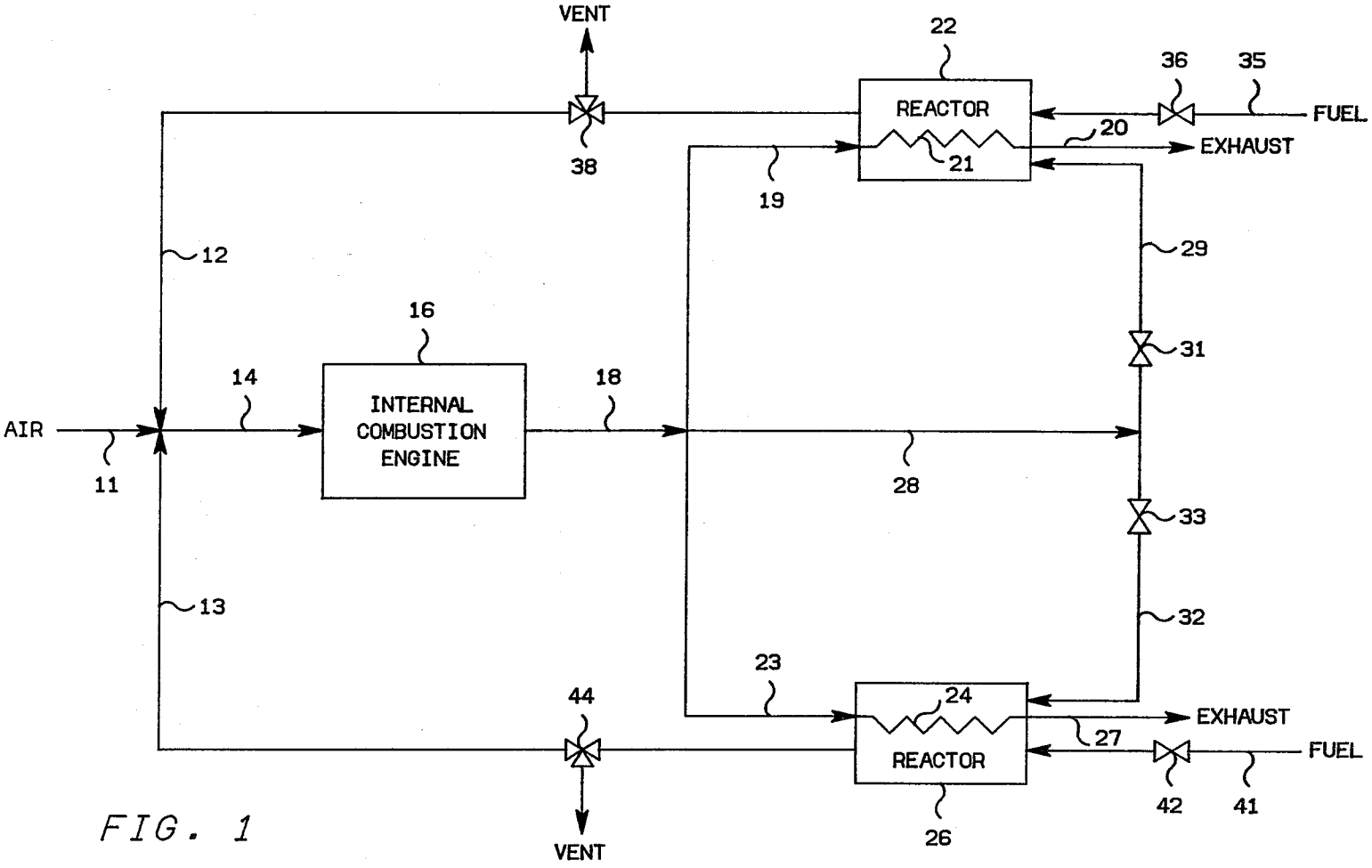

METHOD AND APPARATUS FOR REMOVING HYDROGEN SULFIDE FROM FUEL FOR AN INTERNAL COMBUSTION ENGINE

This application is a division of application Ser. No. 125,434, filed Feb. 28, 1980, now U.S. Pat. No. 4,347,811.

This invention relates to method and apparatus for removing hydrogen sulfide ($H_2S$) from a fuel for an internal combustion engine.

Many fuels for an internal combustion engine may often contain hydrogen sulfide ($H_2S$). It is extremely desirable to remove the $H_2S$ prior to burning the fuel in the internal combustion engine so as to protect the engine against corrosive wear by $H_2S$ and sulfur oxides formed by burning $H_2S$ in the internal combustion engine. It is thus an object of this invention to provide method and apparatus for removing $H_2S$ from a fuel for an internal combustion engine.

In accordance with the present invention, method and apparatus is provided whereby first and second reactors, each containing an absorbing composition which has the capability of removing $H_2S$ from a fuel stream being provided to an internal combustion engine and which can be regenerated in the presence of oxygen, are utilized to remove $H_2S$ from a fuel stream prior to providing the fuel stream to an internal combustion engine. Exhaust from the internal combustion engine can be utilized to heat both the first and second reactors to the desired reaction temperature. The exhaust from the engine, which contains oxygen, is utilized to regenerate the absorbing composition.

For continuous operation, the fuel stream is provided for a first period through the first reactor and is contacted with the absorbing composition in the first reactor before being provided to the internal combustion engine. No fuel is provided through the second reactor during the first period. The absorbing composition in the second reactor is regenerated during the first period by contacting the absorbing composition in the second reactor with the oxygen in the exhaust gas from the internal combustion engine. The first period ends when the absorbing composition in the first reactor has become sulfided to the extent desired, and the flow of the fuel through the first reactor is terminated. The flow of the exhaust gases from the internal combustion engine to the second reactor is also terminated at the end of the first period. During a second, following period the fuel stream is provided through the second reactor and is contacted with the absorbing composition in the second reactor before being provided to the internal combustion engine. The absorbing composition in the first reactor is regenerated during the second period by contacting the absorbing composition in the first reactor with the oxygen in the exhaust gas from the internal combustion engine. This alternating cycle of first and second periods is continued so as to provide continuous removal of $H_2S$ from the fuel stream being provided to the internal combustion engine.

Other objects and advantages of the invention will be apparent from the foregoing brief description of the invention and the claims as well as from the detailed description of the drawing in which:

FIG. 1 is a diagrammatic representation of an internal combustion engine together with two reactors for removing $H_2S$ from the fuel being supplied to the internal combustion engine.

The invention is described in terms of the use of only two reactors. However, more than two reactors could be utilized if desired. Also more than one internal combustion engine could be supplied with fuel from the reactors if desired.

It is believed that the hydrogen sulfide is being absorbed by the absorbing composition and thus the term "absorbing composition" is utilized for the sake of convenience. However, the exact chemical phenomenon is not the inventive feature of the process of the present invention and the use of the term "absorb" in any form in not intended to limit the present invention.

Referring now to the FIG. 1, air flowing through conduit means 11 is combined with a fuel flowing through conduit means 12 and 13 and the resulting mixture is provided through conduit means 14 to the internal combustion engine 16. The mixture is combusted in the internal combustion engine 16 and exhaust gases, which contain free oxygen, from the internal combustion engine 16 are removed through conduit means 18. The exhaust gases are provided through the combination of conduit means 18 and 19 to the heat exchanger 21 which is operably located in the reactor 22. The exhaust gases are removed from the heat exchanger 21 through conduit means 20. In like manner, exhaust gases are provided through the combination of conduit means 18 and 23 to the heat exchanger 24 which is operably located in the reactor 26. The exhaust gases are removed from the heat exchanger 24 through conduit means 27.

Exhaust gases from the internal combustion engine 16 are provided through the combination of conduit means 18, 28 and 29 to the reactor 22. The exhaust gases flowing through conduit means 29 contact the absorbing composition in the reactor 22 and then flow out of the reactor 22 through conduit means 12. Control valve 31 is operably located in conduit means 29. In like manner, the exhaust gases from the internal combustion engine 16 are provided through the combination of conduit means 18, 28 and 32 to the reactor 26. The exhaust gases flowing through conduit means 32 contact the absorbing composition in the reactor 26 and then flow out of the reactor 26 through conduit means 13. Control valve 33 is operably located in conduit means 32.

A fuel is supplied to the reactor 22 through conduit means 35. Control valve 36 is operably located in conduit means 35. The fuel is contacted with absorbing composition in the reactor 22 and is then provided to the internal combustion engine 16 through conduit means 12 as has been previously described. The vent valve 38 is operably located in conduit means 12. In like manner, a fuel, which is preferably but not necessarily the same as the fuel flowing through conduit means 35, is supplied through conduit means 41 to the reactor 26. Control valve 42 is operably located in conduit means 41. The fuel is contacted with the absorbing composition in the reactor 26 and is then provided from the reactor 26 through conduit means 13 to the internal combustion engine 16 as has been previously described. The vent valve 44 is operably located in conduit means 13.

In operation, the absorbing composition in reactor 22 is first utilized during a first period to remove $H_2S$ from the fuel while the absorbing composition contained in reactor 26 is being regenerated. To accomplish this, the vent valve 38 is set to close the vent and open the engine fuel line, valve 36 is opened, valve 31 is closed, valve 33 is opened, valve 42 is closed, and the vent valve 44 is set to the vent position. Fuel flows through conduit means 35 into the reactor 22. $H_2S$ is removed from the fuel and the fuel is provided through conduit means 12 to the internal combustion engine 16. The engine exhaust gases heat the reactor 22 to a temperature in the range of about 400° F. to about 750° F. The fuel is preferably provided through the reactor 22 at a rate of about 1200 volumes of fuel (expressed in terms of gaseous fuel) per volume of promoted zinc titanate absorbing composition per hour.

While the absorbing composition in reactor 22 is removing $H_2S$ from the fuel during the first period, the absorbing composition in reactor 26 is being regenerated by the oxygen present in the exhaust gas flowing through the combination of conduit means 18, 28 and 32. Engine exhaust gases heat the catalytic reactor 26 to a temperature in the range of about 1000° to about 1100° F. by heat exchange. The exhaust gases flow through the reactor 26 and are vented through the vent valve 44.

When the absorbing composition in the reactor 22 has become sulfided to the extent desired, a second period is begun by switching the valves so as to regenerate the absorbing composition in reactor 22 while removing $H_2S$ from the gaseous fuel in reactor 26. This is accomplished by closing control valve 36, opening control valve 31, closing control valve 33, opening control valve 42, setting the vent valve 44 to the internal combustion engine position and setting the vent valve 38 to the vent position. This cyclic process is repeated as required to provide continuous removal of the $H_2S$ in the fuel flowing to the internal combustion engine 16.

The hydrogen sulfide may be removed from any fuel suitable for combustion in an internal combustion engine. The invention is applicable to liquid fuels but gaseous fuels such as methane, ethane, propane, natural gas and other similar gaseous fuels are presently preferred.

Any suitable absorbing composition may be utilized in the present invention. The absorbing composition must have the capability of removing $H_2S$ from a fluid stream. The sulfided absorbing composition must also be regenerable to substantially its original form in the presence of oxygen.

The presently preferred absorbing composition is a promoted zinc titanate absorbing composition which has the capability of removing $H_2S$ from the fuel stream. The absorption process is illustrated by the equation $$Zn_2TiO_4 + 2H_2S \rightarrow 2ZnS + TiO_2 + 2H_2O. \quad \text{(I)}$$

After the promoted zinc titanate absorbing composition has been sulfided to the extent desired, the promoted zinc titanate absorbing composition may be regenerated by contacting the promoted zinc titanate absorbing composition with oxygen. At the temperature at which the zinc sulfide is oxidized, the zinc oxide thus produced recombines with the titanium dioxide to generate the original zinc titanate. Equations (II) and (III) illustrate the regeneration of the promoted zinc titanate absorbing composition.

$$ZnS + O_2 \rightarrow ZnO + SO_x \quad \text{(II)}$$

$$2ZnO + TiO_2 \rightarrow Zn_2TiO_4. \quad \text{(III)}$$

The promoter is at least one member selected from the group consisting of vanadium, chromium, manganese, iron, cobalt, nickel, molybdenum, rhenium, and compounds thereof. The promoter may be present in the absorbing composition composition as oxides, sulfides or as the free element. A preferred combination of promoters is cobalt oxide plus molybdenum oxide where the cobalt:molybdenum atomic ratio is in the range of 0.3:1 to about 0.8:1.

The zinc titanate base of the absorbing composition may be prepared by intimately mixing suitable portions of zinc oxide and titanium dioxide, preferably in a liquid such as water, and calcining the mixture in the presence of free oxygen at a temperature in the range of about 650° C. to about 1050° C., preferably in the range of about 675° C. to about 975° C. A calcining temperature in the range of about 800° C. to about 850° C. is most preferred because the surface area of the absorbing composition is maximized in this temperature range thus producing a more active absorbing composition. The titanium dioxide used in preparing the zinc titanate preferably has extremely fine particle size to promote intimate mixing of the zinc oxide and titanium dioxide. This produces a rapid reaction of the zinc oxide and titanium dioxide which results in a more active adsorbing composition. Preferably the titanium dioxide has an average particle size of less than 100 millimicrons and more preferably less than 30 millimicrons. Flame hydrolyzed titanium dioxide has extremely small particle size and is particularly preferred in preparing the absorbing composition. The atomic ratio of zinc to titanium can be any suitable ratio. The atomic ratio of zinc to titanium will generally lie in the range of about 1:1 to about 3:1 and will preferably lie in the range of about 1.8:1 to about 2.2:1 because the activity of the absorbing composition is greatest for atomic ratios of zinc to titanium in this range. The term "zinc titanate" is used regardless of the atomic ratio of zinc to titanium.

The zinc titanate base of the absorbing composition may also be prepared by coprecipitation from aqueous solutions of a zinc compound and a titanium compound. The aqueous solutions are mixed together and the hydroxides are precipitated by the addition of ammonium hydroxide. The precipitate is then washed, dried and calcined as described in the preceding paragraph. This method of preparation is less preferred than the mixing method because the zinc titanate prepared by the coprecipitation method is softer than the zinc titanate prepared by the mixing method.

The promoter is generally present in the adsorbing composition in the oxide form. The promoter can be added to the zinc titanate by any method known in the art. The promoter can be added to the zinc titanate as powdered oxide and dispersed by any method known in the art such as rolling, shaking or stirring. The preferred method of adding the promoter is by impregnating the preformed zinc titanate with a solution of a compound of the promoting element. After impregnation, the adsorbing composition is preferably dried to remove solvent and is then heated in air at a temperature in the range of about 500° to about 650° C., preferably 540° C., before being utilized in reactors 22 and 26. If more than one promoter is to be used, the absorbing composition is preferably dried and calcined after each promoter addition.

The concentration of the promoter in the absorbing composition may be any suitable concentration. The concentration of vanadium as $V_2O_5$, chromium as $Cr_2O_3$, manganese as $MnO_2$, iron as $Fe_2O_3$, cobalt as CoO, nickel as NiO, molybdenum as $MoO_3$, and tungsten as $WO_3$ can be present at a concentration of about 0.5 to about 20 weight percent calculated on the basis of the promoted adsorbing composition. A mixture of these promoters or compounds containing two or more of these promoters may be utilized. However, the total concentration of the promoters should be in the range of about 1 to about 35 weight percent calculated on the basis of the promoted absorbing composition. The concentration of rhenium, expressed as an element, will generally be in the range of about 0.05 to about 2.5 weight percent based on the weight of the absorbing composition. The rhenium may also be utilized in combination with the vanadium, chromium, manganese, iron, cobalt, nickel, molybdenum and tungsten but again the total concentration of the promoters should not exceed 35 weight percent based on the weight of the total absorbing composition.

Suitable compounds of the promoting elements that can be applied to zinc titanate by solution impregnation include the nitrates, sulfates, acetates and the like of chromium, manganese, iron, cobalt and nickel; ammonium salts of vanadates, molybdates and tungstates.

The invention has been described in terms of a preferred embodiment as is illustrated in FIG. 1. While the invention has been described in terms of the presently preferred embodiment, reasonable variations and modifications are possible by those skilled in the art, within the scope of the described invention and the appended claims.

That which is claimed is:

1. Apparatus comprising:

an internal combustion engine;

a first reactor;

a second reactor, each of said first and second reactors containing an absorbing composition capable of removing hydrogen sulfide from fuel for said internal combustion engine and capable of being regenerated in the presence of oxygen;

means for supplying a fuel for said internal combustion engine through said first reactor to said internal combustion engine, the fuel flowing through said first reactor contacting the absorbing composition contained in said first reactor;

means for supplying a fuel for said internal combustion engine through said second reactor to said internal combustion engine, the fuel flowing through said second reactor contacting the absorbing composition contained in said second reactor;

means for selectively supplying exhaust gases, which contain oxygen, from said internal combustion engine to said first and second reactors;

means for manipulating the flow of fuel to said first and second reactors;

means for manipulating the flow of said exhaust gases to said first and second reactors, the flow of fuel and the flow of said exhaust gases being manipulated in such a manner that if fuel is being supplied through said first reactor said exhaust gases are not supplied to said first reactor and said exhaust gases are supplied to said second reactor, and if fuel is being supplied to said second reactor said exhaust gases are not supplied to said second reactor and said exhaust gases are supplied to said first reactor, wherein the absorbing composition in said first and second reactors removes hydrogen sulfide from the fuel, and said exhaust gases regenerate the absorbing composition in said first and second reactors.

2. Apparatus in accordance with claim 1 additionally comprising:

a first heat exchanger means for supplying heat to said first reactor;

a second heat exchanger means for supplying heat to said second reactor;

means for supplying at least a portion of said exhause gases from said internal combustion engine to said first heat exchanger means; and means for supplying at least a portion of said exhaust gases from said internal combustion engine to said second heat exchanger means.

3. Apparatus in accordance with claim 2 wherein said exhaust gases are vented after being supplied to said first reactor and said second reactor.

4. Apparatus in accordance with claim 1 wherein the fuel flowing through said first reactor and the fuel flowing through said second reactor is natural gas which contains hydrogen sulfide.

5. Apparatus in accordance with claim 1 wherein said absorbing composition comprises zinc titanate and at least one promoter selected from the group consisting of vanadium, chromium, manganese, iron, cobalt, nickel, molybdenum, rhenium, and compounds thereof.

6. Apparatus in accordance with claim 5 wherein said at least one promoter is cobalt and molybdenum.

* * * * *